US005095574A

United States Patent [19]

Khanzadian

[11] Patent Number: 5,095,574

[45] Date of Patent: Mar. 17, 1992

[54] CURVED GLASS CLEANING AND BUFFING DEVICE

[76] Inventor: Sarkis Khanzadian, 2472 3rd St., San Francisco, Calif. 94107

[21] Appl. No.: 674,429

[22] Filed: Mar. 22, 1991

Related U.S. Application Data

[63] Continuation-in-part of Ser. No. 553,173, Jul. 10, 1990, abandoned.

[51] Int. Cl.[5] ..... A47L 4/00

[52] U.S. Cl. ..... 15/118; 15/220 R; 15/223; 15/172; 15/210 R

[58] Field of Search ..... 15/118, 223, 176, 202, 15/244.1, 244.3, 209 D, 210 R, 220 R, 230.11, 104.94, 210 A

[56] References Cited

U.S. PATENT DOCUMENTS

| | | | |
|---|---|---|---|
| 296,092 | 4/1884 | Weed | 15/223 |
| 1,084,184 | 1/1914 | Wenieke | 15/220 R |
| 1,716,171 | 6/1929 | Horihata | 15/220 R |
| 1,767,313 | 6/1930 | Salvucci | 15/226 |
| 2,008,942 | 7/1935 | Beall | 15/209 D |
| 2,514,496 | 7/1950 | Jones et al. | 15/223 |
| 2,534,982 | 12/1950 | Mayes | 15/223 |
| 2,694,212 | 11/1954 | McGraw | 15/220 R |
| 3,083,392 | 4/1963 | Sewell | 15/118 |
| 3,146,479 | 9/1964 | Stoker | 15/244.1 |
| 3,293,684 | 12/1966 | Tundermann | 15/244.1 |
| 3,374,498 | 3/1968 | Bailey | 15/119 A |
| 3,403,420 | 10/1968 | MacLaughlin | 15/244.1 |
| 3,491,397 | 1/1970 | Hesener | 15/118 |
| 3,520,628 | 7/1970 | Moceri | 15/118 |
| 3,832,749 | 9/1974 | Hawk | 15/230.11 |
| 4,821,359 | 4/1989 | Deziel et al. | 15/223 |

FOREIGN PATENT DOCUMENTS

| | | | |
|---|---|---|---|
| 523004 | 10/1953 | Belgium | 15/230.11 |
| 1059320 | 6/1959 | Fed. Rep. of Germany | 15/230.11 |
| 2901848 | 7/1980 | Fed. Rep. of Germany | 15/230.11 |

*Primary Examiner*—Edward L. Roberts
*Assistant Examiner*—Patrick F. Brinson
*Attorney, Agent, or Firm*—Jeffrey A. Hall

[57] ABSTRACT

A cleaning and buffing device for curved surfaces is disclosed in which a tapered cleaning element is rotatably secured to a C-shaped bracket element having a first arm, a second arm, and a connecting member affixed to an elongated handle. The C-shaped bracket element is mounted onto the elongated handle and the cleaning element rotatably mounted on the first arm of the C-shaped bracket. The cleaning element has a cleaning surface having a sponge layer detachably affixed thereto by adhesives and a buffing surface having a plurality of paper pads detachably affixed thereto by adhesives. The cleaning element automatically rotates 180 degrees by rotating the handle either clockwise or counter-clockwise, and rotates 180 or 360 degrees by moving the handle in a forward and in a rearward direction.

23 Claims, 4 Drawing Sheets

CURVED GLASS CLEANING AND BUFFING DEVICE

This is a continuation-in-part of Ser. No. 07/553,173, filed July 10, 1990, now abandoned.

BACKGROUND OF THE INVENTION

1. Field of Invention

This invention relates to curved glass cleaning devices, particularly to curved glass cleaning devices for cleaning surfaces such as the interior surfaces of automobile windows, skylights, computer monitors, television set glass surfaces, and the like.

2. Description of Prior Art

Many, if not most automobile owners and other consumers would prefer a simple, reliable, and convenient device for cleaning inclined and curved glass surfaces.

Heretofore, a wide variety of glass cleaning devices have been proposed and implemented. None, however, are known to applicant which adequately address the problem of cleaning and buffing curved or angled glass where the human hand does not readily conform to the angle necessary for proper cleaning.

It would be very desirable therefore to have an efficient, reliable, and effective means to clean and buff curved or angled glass such as found on the interior surfaces of automobile windows, skylights, French door frames, oven doors, computer monitors, dishwashers, television set glass surfaces, refrigerator doors, and the like. Moreover, it would be advantageous to have a device where different buffing surfaces could be conveniently substituted, for example, foam, cloth chamois, etc., thereby enabling the device to be utilized to clean and oil articles such as fine tables and furniture.

OBJECTS AND ADVANTAGES

Accordingly I claim the following as the objects and advantages of the invention: to provide a simple and efficient window-cleaning device which is adapted to permit a user or operator to clean and buff angled or curved window surfaces while applying proper tension to the device, to provide a device which is convenient and efficient to use on both flat surfaces and on curved or angled surfaces, to provide such a device in which a cleaning element is disposed vertically perpendicular to a handle element on a bracket element and is freely rotatable thereon and may be moved or traversed horizontally across the glass surface cleaning angled, curved, or flat surfaces, to provide such a s device which requires a minimum of skill and training to use, to provide such a device having protective means so that edges of objects being cleaned are not scratched or damaged during cleaning, to provide such a device having removable and replaceable cleaning and buffing surfaces, to provide such a device having laminated paper pads removably affixed thereto for convenient buffing of surfaces, and to provide such a tool which can do a complete job of cleaning and buffing, without discomfort or harm to the wrist and arm.

In addition I claim the following additional objects and advantages: to provide a glass cleaning and buffing device which can clean the complete inner surface of automobile windows, skylights, computer monitors, television set glass surfaces, refrigerator doors, and the like, to provide such a device which can buff as well as clean, to provide such a device where the cleaning element cleans flush against the glass surface regardless of the angle at which the handle is held for increased safety and versatility, to provide such a device which automatically rotates 180 degrees by rotating the handle either clockwise or counter-clockwise, to provide such a device wherein the cleaning element can be rotated 180 or 360 degrees by moving the handle in a forward and then in a rearward direction, to provide such a device wherein a sponge cleaning element when positioned with the tapered side facing down towards the dash of an automobile or other horizontal surface being cleaned will automatically rotate to the opposite side when lifted away from the surface being cleaned, and to provide such device which can be adjusted for cleaning a wide variety of surfaces.

Further objects and advantages will become apparent from a consideration of the ensuing description and the accompanying drawings.

SUMMARY OF THE INVENTION

This invention overcomes the above, briefly described problems by providing a curved glass cleaner and buffer that is self-positioning, freely rotatable, easy to operate, and adapted to effectively clean and buff a wide variety of surfaces.

The curved glass cleaner and buffer of this invention comprises an elongated handle which in various embodiments may have a cleaning fluid dispensing bottle operably secured thereto or therein. A C-shaped bracket element extends from one end of said handle and is adapted to rotatably secure a tapered cleaning element thereon. The C-shaped bracket element preferably has a first arm, a second arm, and a connecting member. The tapered cleaning element is rotatably secured to said first arm and is self-positioning. When the handle is rotated in a clockwise or in a counter clockwise direction the cleaning element automatically rotates 180 degrees. When the handle is moved in a forward and in a rearward direction the cleaning element rotates 180 or 360 degrees, depending upon the amount of force applied.

A detachable foam or sponge cleaning layer is affixed to one face of said cleaning element and a plurality of paper pads, detachably laminated together, are affixed to an opposing face of said cleaning element.

The C-shaped bracket preferably has a protective sleeve surrounding exposed segments thereof to minimize scratching, scuffing, marring, or other abrasive damage when the cleaning element contacts edges or frames of the glass surface being cleaned.

DRAWING REFERENCE NUMERALS

10—curved glass cleaning and buffing device
12—handle
14—C-shaped bracket
15—connecting member
16—crimping arm 26
17—second arm of C-shaped bracket
18—sponge/foam layer
19—cleaning surface
20—perimeter protective cushion
21—buffing surface
22—plurality of paper pads
23—adhesive (securing paper pads and foam cushion together)
24—taper
25—foam cushion
26—first arm C-shaped bracket
28—cleaning element
29—adhesive (securing sponge/foam layer to cleaning element)
30—aperture
32—rounded corners
34—square corner
36—flat surface
38—convex surface
40—protective sleeve

DETAILED DESCRIPTION OF THE PREFERRED EMBODIMENT OF THE INVENTION

Figure 1:
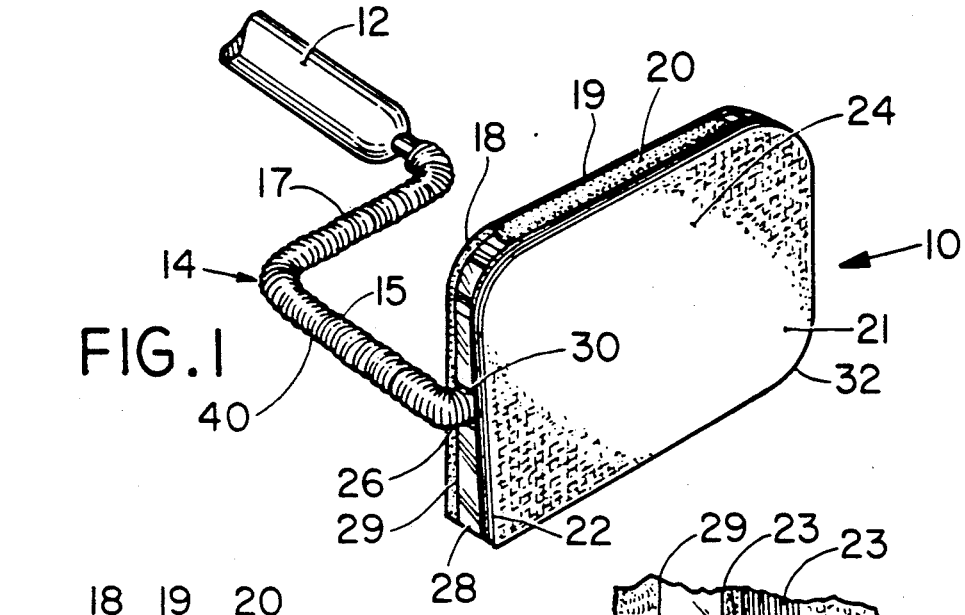
FIG. 1 shows a top perspective view of a curved glass cleaning and buffing device, according to the invention.
Figure 2:
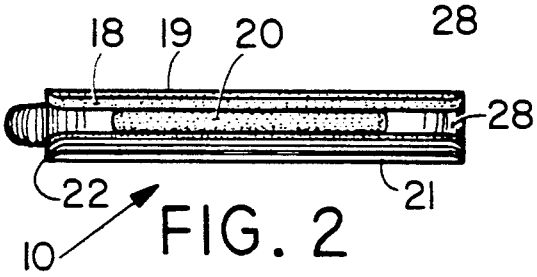
FIG. 2 shows a top view of such device, according to the invention.
Figure 7:
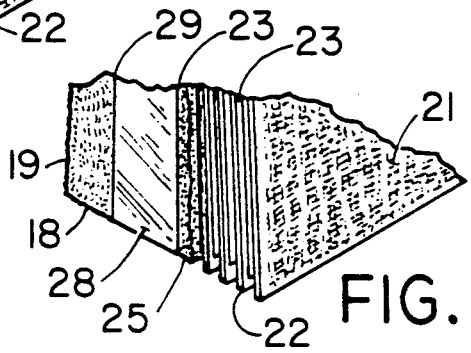
FIG. 7 shows a cut-away perspective of such device showing detachable laminated paper pads, cleaning element, and detachable sponge layer, according to the invention.
Figure 3:
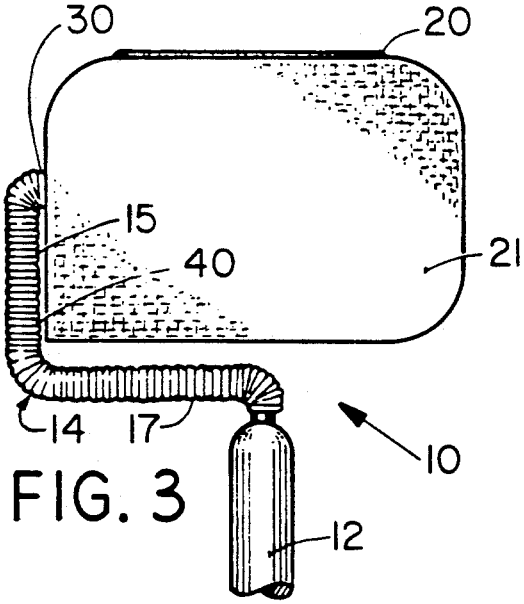
FIG. 3 shows a front view of such device, according to the invention.
Figure 5:
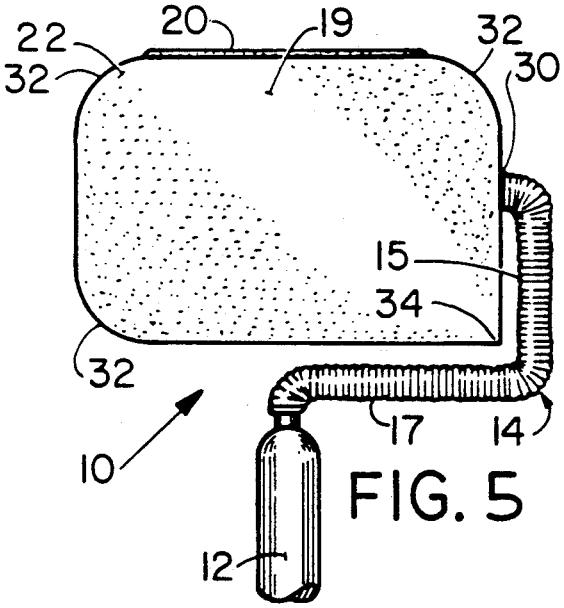
FIG. 5 shows a rear view of such device, according to the invention.
Figure 4:
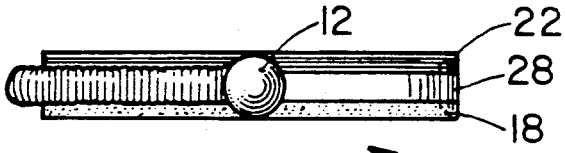
FIG. 4 shows a bottom view of such device, according to the invention.
Figure 6:
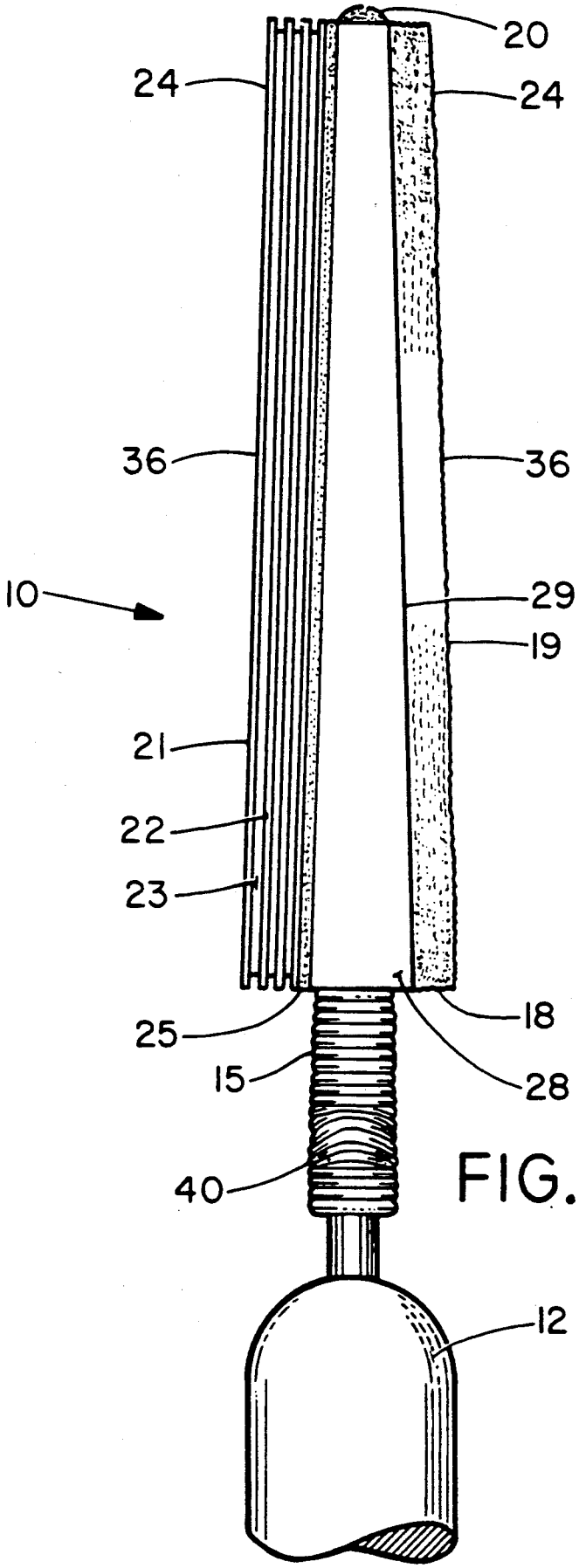
FIG. 6 shows a side view of such device, according to the invention.
Figure 9:
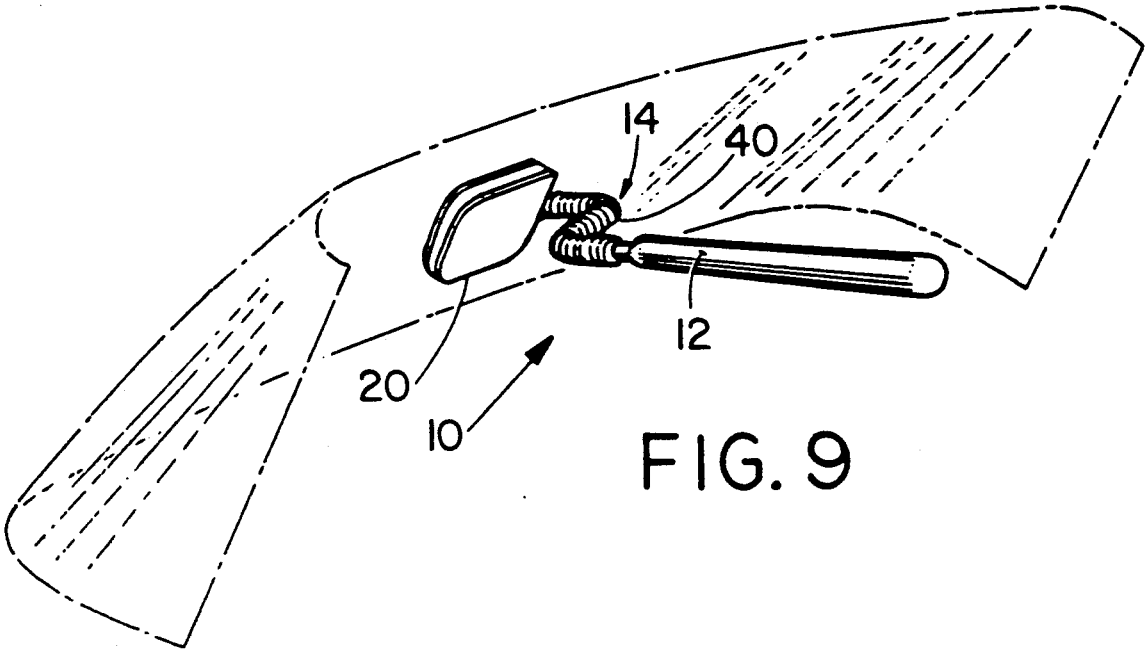
FIG. 9 shows a top perspective view of such device in position for use against an inner surface of an automobile window.
Figure 8:
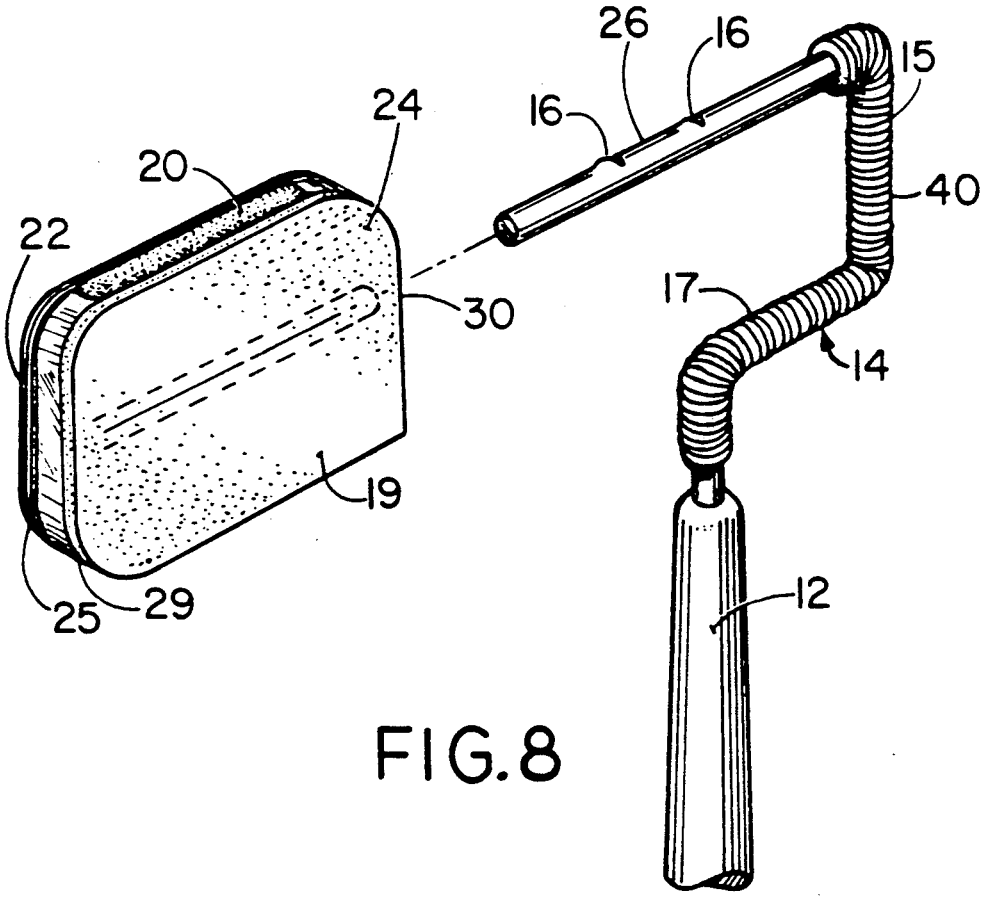
FIG. 8 shows a perspective view of such device having the cleaning element detached from the C-shaped bracket element, according to the invention.

FIG. 1 shows a curved glass cleaning and buffing device 10 according to the preferred embodiment of the invention. The device comprises a handle 12, preferably made of plastic which is secured to bracket element 14. Bracket element 14 comprises a C-shaped bracket having a first arm 26, and a second arm 17, united at their lower ends by a connecting member 15 which is attached at one end to one end of the first arm 26, the first arm 26 being designed for application of proper tension to a cleaning element 28. First arm 26 is fixedly connected to bracket element 14 with a pivot axis disposed through one tapered side, between the cleaning and buffing surfaces generally parallel to the top portion thereof. In the preferred embodiment, cleaning element 28 is rotatably secured to first arm 26 by passing arm 26 through an aperture 30 in cleaning element 28 to offset the pivot axis and is rotatably secured thereto by a crimping 16 of arm 26 and conforming the molding of cleaning element 28 to securely encompass arm 26.

The cleaning element 28 preferably is composed of a flexibly rigid material such as polypropylene, polyurethane, rubber, semi-rigid plastic or the like, and having a sponge or foam layer 18 having a cleaning surface 19 secured to the cleaning side of the cleaning element 28 and which is detachably affixed to cleaning element 28. A plurality of paper pads 22 having buffing surface 21 secured to the buffing side of cleaning element 28 and is affixed to cleaning element 28 and is best seen in FIGS 1, 2, 7, and 6. The sponge layer or foam layer 18 is detachably secured to the cleaning side of the cleaning element by adhesives 29 and may be conveniently removed and replaced if desired. For example, if the sponge layer 18 is soiled it may be removed, washed off, and then replaced on cleaning element 28. The plurality of paper pads 22 are detachably laminated to sponge cushion 25 which is laminated to the cleaning side of cleaning element 28 by a plurality of adhesives 23. Paper pads 22 are removably secured together by adhesives 23 best seen in FIG. 7. Conveniently, this provides a fresh supply of paper after each use, by simply peeling away the spent paper pad, discarding it, and then using the next clean and dry pad. Furthermore, sponge cushion 25 provides for ease of buffing when only one or few paper pads remain on cleaning element 28.

Alternatively both sides of cleaning element 28 may have a sponge layer 18 affixed thereto or a plurality of paper pads affixed thereto. Cleaning element 28 has taper 24 shown in FIGS. 1 to 10. The cleaning element 28 having taper 24 results in a narrow top portion, wider bottom portion, and opposing tapered side portions and may be rotated at any angle on first arm 26 enabling the efficient and complete cleaning of curved or angled glass. This tapered construction provides a built-in position seeking feature and thereby forming generally rectangular cleaning and buffing surfaces. For example, when use of one side of the cleaning element, such as sponge layer 18 is complete, the user simply lifts the cleaning and buffing device 10 away from the cleaned surface and the other side or paper layer side for buffing automatically pivots into position for use. Moreover, cleaning element 28 automatically rotates 180 degrees when handle 12 is rotated in either a clockwise or in a counter-clockwise direction. If it is desired to rotate cleaning element 28 by 360 degrees handle 12 is moved in a forward and in a rearward direction resulting in the rotation of cleaning element 28.

Referring to FIGS. 1, 6, 8, 9, and 10 a perimeter protective cushion 20 is provided on cleaning element 28 and is preferably composed of a fabric such as wool or a semi-rigid plastic for protecting edges and surfaces from damaging abrasions. The cushion 20 may be attached to the cleaning element 28 by any means well known in the art.

A protective sleeve 40 encompasses exposed portions of C-bracket 14 as illustrated in FIGS. 1, 3, 5, 6, 8, and 9. The cleaning element 28 preferably is configured having a plurality of rounded corners 32, three in the preferred embodiment, and one square corner 34. Such configuration allows cleaning and buffing device 10 to be used in a wide variety of applications such as cleaning automobile windows, skylights, computer monitors, and the like. Cleaning surface 19 and buffing surface 21 are preferably substantially flat.

Figure 10:
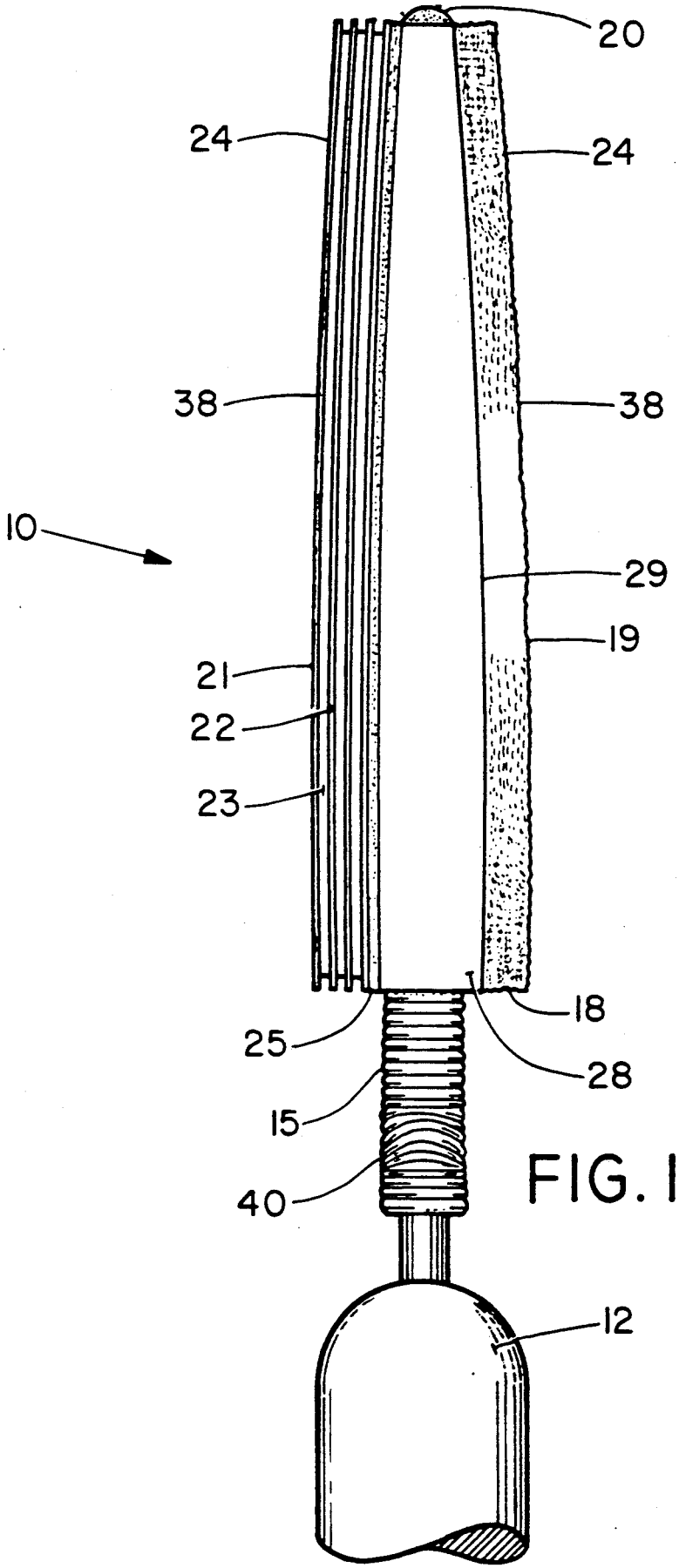
FIG. 10 shows a side view of an alternative embodiment of such device having substantially convex cleaning and buffing surfaces.

The curved glass cleaner and buffing device has been described according to the preferred embodiment of the invention. As an alternative to the above described preferred embodiment cleaning surface 19 and buffing surface 21 are formed having a convex surface 38 as shown in FIG. 10 for use on highly contoured surfaces.

Other embodiments include cleaning and buffing device 10 having a small container for soap, cleaning fluid or the like, attached to the handle 12. A pump actuates a nozzle located adjacent to or perpendicular with the sponge surface. Alternatively, handle 12 may be constructed having a cavity therein to provide for a storage container for soap, cleaning fluid, water or the like. In this embodiment a pump is incorporated into the upper portion of handle 12.

In operation and use the cleaning and buffing device 10 is primarily useful for cleaning and buffing glass surfaces, however, it is also useful in other cleaning and buffing work as well, such as cleaning and buffing refrigerator doors, oven doors, dishwashers, computer monitors and the like. The cleaning and buffing device 10 is especially useful for the interior of automobile front and rear windshields and side windows. Cleaning element 28 with one side having sponge layer 18 and the other side having a plurality of paper pads 22, may initially be applied by washing the surface with sponge layer 18 which may be wetted with soap, water, cleaning fluid or the like. The user then lifts the cleaning and buffing device 10 away from the surface, and the buffing surface 21, having paper pads 22, automatically pivots into position for use. The surface may then be buffed or dried with surface 21. The tapered shape of cleaning element 28 enables the user to clean hard to reach and otherwise almost inaccessible areas of the glass, for example, where the window glass meets the dashboard of an automobile. Moreover, when cleaning and buffing device 10 is used on a horizontal surface, for example, when cleaning the glass surface of a copy machine, if cleaning element 28 is lifted away from the surface, cleaning element automatically rotates 180 degrees resulting in a reversal of the side, either cleaning surface 19 or buffing surface 21, being used. The tapered shape of cleaning element 28 in conjunction with its rotatable attachment to swivel arm 26 provides for the built-in self positioning function of cleaning and buffing device 10. Weights could be added to one side of the device to achieve the same effect.

Sponge layer 18 or paper pads 22 may be replaced as needed. The entire sponge layer 18 or plurality of paper pads 22 are easily removed from cleaning element 28 for replacement purposes. The paper pads 22 may be substituted by a variety of materials and are preferably constructed in multi-layers so that when one layer becomes soiled after use the user can peel the soiled layer away and use the next clean layer, or alternatively, the paper layer can be added to with new replacements as needed.

While the above description contains many specificities, these should not be construed as limitations on the scope of the invention, but merely as exemplifications of preferred embodiments thereof. Those skilled in the art will envision many other possible variations are within its scope. For example, skilled artisans will readily be able to make the cleaning and buffing device out of alternative materials or change the dimensions and shapes of the various embodiments. Various delivery systems for wetting the cleaning element may be used such as a hollow handle having pump means operably linked therewith to deliver fluid to the cleaning element or container means secured to the handle for holding cleaning fluid and having pump means operably connected thereto deliver fluid to the cleaning element, or the like. Various absorbent material may be substituted for the paper layer, or alternatively both sides of the cleaning elements may be supplied with a sponge layer. Accordingly, the reader is requested to determine the scope of the invention by the appended claims and their legal equivalents, and not by the examples which have been given.

I claim:

1. A self-positioning device for cleaning and buffing the inner curved and inclined surfaces of automobile windows, comprising:

an elongated handle;

a C-shaped bracket element having a first arm; a connecting member attached at one end to one end of the first arm; a second arm in parallel, spaced relation to the first arm and connected at one end to the other end of the connecting member; with the other end of the second arm connected to one end of the handle;

a cleaning element having a narrow top portion, a wider bottom portion, and opposing tapered side portions forming opposing, generally rectangular cleaning and buffing surfaces, with a pivot axis disposed through one tapered side between the cleaning and buffing surfaces at an off-set location generally parallel to the top portion, the off-set location disposed closer to the top portion than to the bottom portion; the said first arm of the C-shaped bracket element sized to rotatably receive the cleaning element for 360 degree rotation between the first and second spaced arms of the C-shaped bracket; a cleaning surface secured to the cleaning side of the cleaning element, and a buffing surface secured to the buffing side of the cleaning element;

and a means for securing the cleaning element onto the first arm of the C-shaped bracket element.

2. The self-positioning cleaning and buffing device of claim 1 wherein said first arm of said C-shaped bracket is substantially perpendicular to said elongated handle, and said second arm of the C-shaped bracket is oriented parallel to the elongated handle, so that when said handle is rotated the cleaning element automatically rotates 180 degrees, and when said handle is moved in a forward and a rearward direction said cleaning element rotates 180 degrees automatically.

3. The self-positioning cleaning and buffing device of claim 1 wherein said cleaning element is configured having three rounded corners and a square corner, and said cleaning side and said buffing side are substantially flat.

4. The self-positioning cleaning and buffing device of claim 1 wherein said cleaning surface and said buffing surface are substantially convex and detachable from said cleaning element.

5. The self-positioning cleaning and buffing device of claim 1 wherein said cleaning element has an aperture therein for rotatably engagement with said first arm of said C-shaped bracket element.

6. The self-positioning cleaning and buffing device of claim 1 wherein said cleaning surface further comprises a sponge layer disposed on said cleaning side of said cleaning element and said buffing surface further comprises a plurality of paper pads removably secured to said buffing side of the cleaning element.

7. The self-positioning cleaning and buffing device of claim 6 wherein said sponge layer is secured by an adhesive to said cleaning side.

8. The self-positioning cleaning and buffing device of claim 6 wherein said plurality of paper pads is composed of individual paper pads detachably laminated together by an adhesive and individually removably from said cleaning surface.

9. The self-positioning cleaning and buffing device of claim 1 wherein said cleaning element is composed of a semi-rigid material.

10. The self-positioning cleaning and buffing device of claim 1 wherein said elongated handle is composed of plastic.

11. The self-positioning cleaning and buffing device of claim 1 wherein connecting member of said C-shaped bracket is encompassed with a protective sleeve.

12. The self-positioning cleaning and buffing device of claim 1 further comprising a perimeter protective cushion secured to said cleaning element so as to prevent scuffing and abrasion of a surface being cleaned.

13. A glass cleaning and buffing device for cleaning and buffing glass surfaces, comprising:

an elongated handle;

a C-shaped bracket element having a first arm having a crimp therein; a connecting member attached at one end to one end of the first arm; a second arm in parallel, spaced relation to the first arm and connected at one end to the other end of the connecting member; with the other end of the second arm connected to one end of the handle;

a cleaning element having a narrow top portion, a wider bottom portion, and opposing tapered side portions forming opposing, generally rectangular cleaning and buffing surfaces, with a pivot axis disposed through one tapered side between the cleaning and buffing surfaces at an off-set location generally parallel to the top portion, the off-set location disposed closer to the top portion than to the bottom portion; the said first arm of the C-shaped bracket element sized to rotatably receive the cleaning element for 360 degree rotation between the first and second spaced arms of the C-shaped bracket; a cleaning surface secured to the cleaning side of the cleaning element, and a buffing surface secured to the buffing side of the cleaning element;

and a means for securing the cleaning element onto the first arm of the C-shaped bracket element.

14. The glass cleaning and buffing device of claim 13 wherein said first arm of said C-shaped bracket is substantially perpendicular to said elongated handle, and said second arm of the C-shaped bracket is oriented parallel to the elongated handle, so that when said handle is rotated said cleaning element automatically rotates 180 degrees, and when said handle is moved in a forward and in a rearward direction, said cleaning element rotates 180 or 360 degrees automatically.

15. The glass cleaning and buffing device of claim 13 wherein said cleaning element is configured having three rounded corners and a square corner, and said cleaning side and said buffing side are substantially flat.

16. The glass cleaning and buffing device of claim 13 wherein said cleaning surface and said buffing surface are substantially convex.

17. The glass cleaning and buffing device of claim 13 wherein said cleaning element has an aperture therein for rotatable engagement with said first arm of said C-shaped bracket.

18. The glass cleaning and buffing device of claim 13 wherein said means for securing said cleaning element onto said first arm of said C-shaped bracket element comprises a crimping of said first arm of said C-shaped bracket element and conforming the cleaning element to securedly encompass the first arm of the C-shaped bracket and said crimping.

19. The glass cleaning and buffing device of claim 13 wherein said cleaning surface comprises a sponge layer disposed on said cleaning side of said cleaning element and said buffing surface comprises a plurality of paper pads removable secured to said buffing side of said cleaning element.

20. The glass cleaning and buffing device of claim 13 wherein said sponge layer is detachably secured by an adhesive to said cleaning side.

21. The glass cleaning and buffing device of claim 13 wherein said plurality of paper pads is composed of individual paper pads detachably laminated together by an adhesive thereby preventing moisture from penetrating successive layers, and individually removable from said buffing side.

22. The glass cleaning and buffing device of claim 13 wherein said cleaning element is composed of a semi-rigid material.

23. The glass cleaning and buffing device of claim 13 wherein said elongated handle is composed of a plastic.

* * * * *